US005950240A

United States Patent [19]

Carpenter et al.

[11] Patent Number: 5,950,240

[45] Date of Patent: Sep. 14, 1999

[54] ARRANGEMENT FOR RETAINING AN ARTICLE OF WEAR TO A JACKET OR OTHER GARMENT

[75] Inventors: Jake Burton Carpenter, Stowe; Peter M. Curran, Burlington; James H. Sadler, Colchester, all of Vt.

[73] Assignee: The Burton Corporation, Burlington, Vt.

[21] Appl. No.: 08/692,148

[22] Filed: Aug. 5, 1996

[51] Int. Cl.[6] ..... A41D 19/00; A41B 7/00; A41F 19/00

[52] U.S. Cl. ..... 2/160; 2/265; 2/300; 2/271; 2/123

[58] Field of Search ..... 2/101, 69, 240, 2/244, 265, 266, 117, 137, 144, 145, 160, 300, 336, 341, 271, 1, 123, 124, 16, 17, 139, 158, 159, 161.1, 162; 24/15, 3.13, 41.1, 42, 43, 44, 45, 46, 49.1, 58, 68 T, 904, 300, 115 G

[56] References Cited

U.S. PATENT DOCUMENTS

| | | | |
|---|---|---|---|
| 374,676 | 12/1887 | Helfaer | 2/160 X |
| 1,361,565 | 12/1920 | Christy . | |
| 1,426,797 | 8/1922 | Wangelin | 2/160 |
| 1,645,833 | 10/1927 | Torme | 2/124 |
| 2,041,254 | 5/1936 | Lipshutz | 2/160 |
| 2,316,033 | 4/1943 | Walsh . | |
| 2,342,974 | 2/1944 | Sepessy | 2/240 |
| 2,516,241 | 7/1950 | Mulheran | 2/160 |
| 2,710,409 | 6/1955 | Burandt . | |
| 3,466,667 | 9/1969 | Rosner | 2/240 |
| 3,529,329 | 9/1970 | Burleson | 2/240 X |
| 4,159,792 | 7/1979 | Siegal . | |
| 4,351,067 | 9/1982 | Bartels | 2/160 |
| 4,791,682 | 12/1988 | Herr et al. . | |
| 4,868,927 | 9/1989 | Bourdeau et al. . | |
| 4,885,805 | 12/1989 | Mason | 2/244 |
| 5,029,344 | 7/1991 | Shannon et al. | 2/69 |
| 5,263,202 | 11/1993 | Siberell . | |
| 5,353,441 | 10/1994 | Lazorchak | 2/240 X |
| 5,375,263 | 12/1994 | Cuccia . | |

FOREIGN PATENT DOCUMENTS

| | | |
|---|---|---|
| 55-163969 | 11/1980 | Japan . |
| 59-13788 | 8/1985 | Japan . |
| 468296 | 3/1936 | United Kingdom . |

OTHER PUBLICATIONS

Partial translation of Japanese Utility Model Appln. No. 55–163969 (Laid–open Appln. No. 57–87013), one page.

Partial translation of Japanese Utility Model Appln. No. 59–13788 (Laid–open Appln. No. 60–127319), one page.

*Primary Examiner*—John J. Calvert
*Assistant Examiner*—Shirra L. Jenkins
*Attorney, Agent, or Firm*—Wolf, Greenfield & Sacks, P.C.

[57] ABSTRACT

To retain a glove or mitten to a jacket, an elastic loop is sewn into the cuff of the sleeve which is sized to securely receive the barrel shaped cord lock at the end of a glove leash. The narrow glove loop opening prevents the larger cord lock from slipping through the loop, securely retaining the unworn glove to the jacket.

31 Claims, 1 Drawing Sheet

ARRANGEMENT FOR RETAINING AN ARTICLE OF WEAR TO A JACKET OR OTHER GARMENT

FIELD OF INVENTION

The invention relates to an arrangement for retaining an article of wear to a jacket or other garment and particularly relates to securing an unworn hand covering, such as a glove or mitten, to outer clothing.

BACKGROUND OF THE INVENTION

Many arrangements have been proposed to prevent the loss of gloves, mittens and other hand coverings which have been temporarily removed to expose the wearer's hands. It has been known to extend a strap or tape, that is connected to each glove, through both sleeves and the back portion of the garment. Leashes also have been provided which extend from the sleeve of the garment and include a clip or safety pin for securing to the mitten.

The opportunity to mislay gloves or mittens is particularly acute when a person is snowboarding because the bulky snowboarding gloves or mittens are usually removed each time the rider secures her boot to the binding. Unlike skis which point straight ahead, a snowboard is positioned sideways to the rider requiring one of the legs to be freed from its binding so that the board can be oriented like a ski during the chairlift ride up the mountain. After exiting the chairlift, the rider must resecure her boot to the binding. It is very difficult for a rider to manipulate the binding straps and buckles with gloved hands and, consequently, the snowboarder usually removes her gloves when fastening the boot to binding. A snowboarder might try to hold her glove between her arms and body or in her mouth, lay her gloves on the snow, or store her gloves in a jacket pocket. These techniques, however, have proven inconvenient and impractical. The wind may blow away a glove placed on the snow or that falls out of a pocket onto the mountain. Snow may collect inside the glove, wetting the insulation.

Consequently, a need exists for an arrangement that prevents a handcovering, such as a glove or mitten, from becoming lost when the wearer's hands are exposed, for example, when a snowboard rider resecures her boot to the binding after exiting a chairlift.

SUMMARY OF THE INVENTION

The invention is an arrangement for securing an article of wear, such as a glove, neckwarmer, hat, cap, or decorative object, to a jacket or other outer garment and is particularly suitable for retaining a glove, mitten or other hand covering to the sleeve of a jacket or other outer garment to prevent the glove from becoming lost when the user exposes her hands.

In one embodiment of the invention, the arrangement includes a garment and a retainer such as a loop secured to the garment that defines a first opening. An extension of an article of wear is provided with an anchor that has at least one dimension that is larger than the first opening. With the extension passing through the opening, and the anchor positioned so that the at least one dimension is adjacent the narrower first opening of the loop, the article of wear is prevented from inadvertently separating from the garment.

In another embodiment of the invention, the arrangement includes an elastic fabric strip, preferably formed of shock cord, that has been configured as a loop with adjacent end segments being stitched at the inside cuff of a jacket sleeve. The loop opening is sized to receive and releasably hold a barrel shaped cord lock, extending from the end of a glove leash. The elastic loop expands outwardly as the larger anchoring member is passed through the opening and then retracts to its natural smaller size, securing the anchoring member and the glove leash and glove connected thereto, to the jacket sleeve. When the wearer removes a glove, it drops downwards but is prevented from hitting the snow covered ground by the cooperation of the elastic loop and cord lock and the glove leash extending therefrom. The user simply reinserts her hand into the hanging glove to again insulate herself from the elements.

In another embodiment of the invention, a bar tack stitching pattern or other concentrated series of stitches may be employed to attach the elastic loop to the inner cuff of the jacket or other desired location for mounting the loop to the garment. The strong bar tack stitches prevent the loop from being torn away if the user pulls to hard on the glove or if the freely hanging glove becomes tangled or hooked onto an object as the user moves by. Other arrangements for reinforcing the attachment of the loop to the cuff also are contemplated as part of the invention hereof.

It is an object of the invention to provide an arrangement for preventing loss of an article of wear.

It is a further object of the invention to provide an arrangement for allowing an unworn glove, mitten or other handcovering to be securely retained to a jacket or other outer garment.

It is another object of the invention to provide an arrangement which is adaptable for use with gloves or other handcoverings including a leash or other cord or strap extensions.

It is a still further object of the invention to provide a reinforced and secure arrangement that is resistant to tearing and premature detachment.

Other objects and features of the present invention will become apparent from the following detailed description when taken in connection with the accompanying drawings. It is to be understood that the drawings are designed for the purpose of illustration only and are not intended as a definition of the limits of the invention.

DESCRIPTION OF THE DRAWINGS

The foregoing and other objects and advantages of the invention may be appreciated more fully from the following drawing in which.

DESCRIPTION OF A PREFERRED EMBODIMENT

Figure 1:
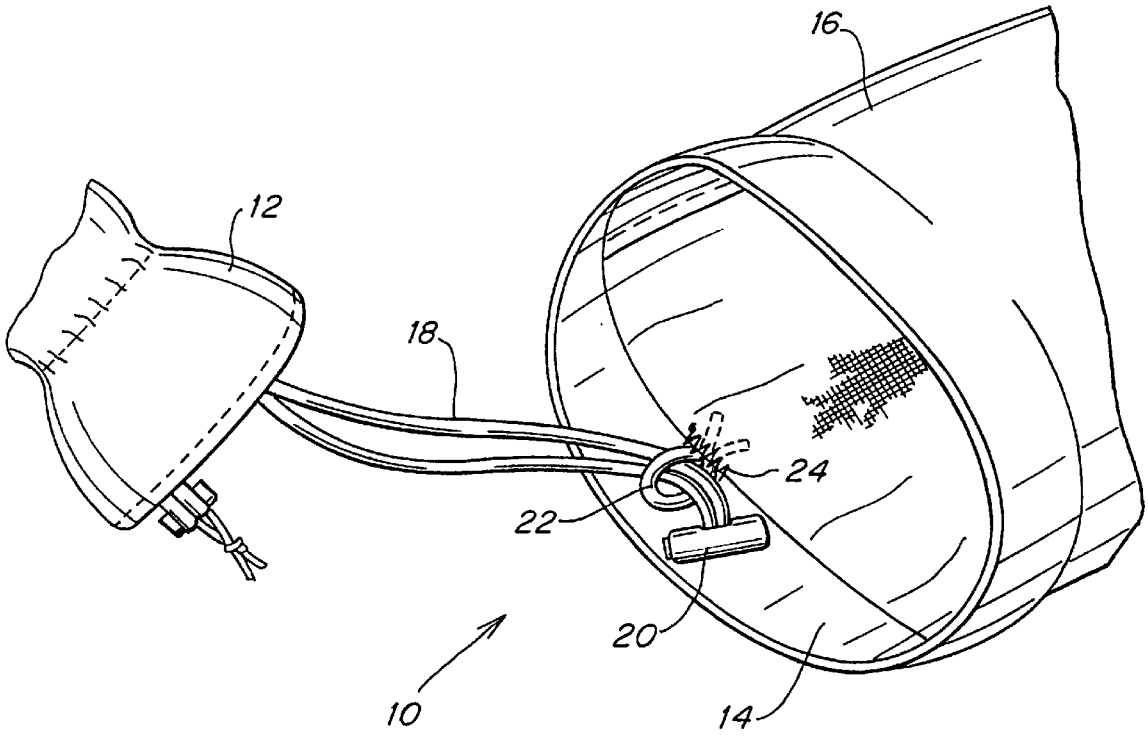
FIG. 1 is an illustration of a glove secured to a jacket sleeve in accordance with the present invention.

The invention will be described in connection with retaining an unworn glove to a jacket. The arrangement contemplated, however, has broader applications and may be employed to retain, and thereby prevent mislaying of, other articles of wear including neck, head and ear warmers, hats, caps, scarfs, and decorative ornaments, to name but a few. Further, while the illustrated embodiment will be described in connection with a glove, other hand coverings such as mittens are equally suitable for use in the present inventive arrangement.

An arrangement 10 for securely retaining a glove 12 to the cuff 14 of a jacket or other garment sleeve 16 is illustrated in the figure. The glove 12 includes a leash 18 having a barrel shaped cord lock 20 that may be moveable along the length of the leash. The barrel, illustrated in a position at the end of the leash, may be received through and secured against, the narrower opening of an elastic loop 22 that has been fixed to the inside cuff of the jacket sleeve. The cooperation of the larger barrel and smaller loop opening prevents the glove from being separated from the jacket of the wearer. The barrel may be oriented so that its longer dimension is offset from, and preferably perpendicular to, the longer dimension or axis of the loop, minimizing the likelihood of inadvertent pull out of the anchor.

The loop 22 may be formed from a flexible, resilient cord, such as a nylon covered rubber strand, commonly referred to as shock cord, and preferably is water resistant or includes a water resistant coating. Opposite ends of the cord may be brought together to form a loop with the adjacent end segments being attached to the cuff of the garment by bar tack stitching as at 24, or other stitching patterns or fastening mechanisms such as gluing, tacking or stapling, for example. Provisional stitches may be applied through the end segments to temporarily secure the loop to the cuff prior to the bar tacking or other fastening operation. The size of the loop and the thickness of the cord may vary depending upon the intended range of sizes of cord lock, or other anchoring member, which will be used and the weight of the glove to be worn by the user, and may be selected to ensure that the hanging glove will not inadvertently pull the cord lock through the elastic loop. The loop may point outwardly towards the wearer's hand or inwardly up the sleeve. The loop may be located to minimize twisting of the leash and, consequently, may be placed on the interior side of each arm of the garment and preferably at an intermediate location as is illustrated. Locating the loop in the cuff region makes the loss prevention arrangement convenient and accessible to the user, without adversely affecting the aesthetics of the outer garment. Additionally, providing the loop in the cuff region ensures that the arrangement will be usable with the common lengths of many commercially available glove leashes. Notwithstanding, the loop may be located anywhere within or outside the sleeve or elsewhere on the garment or jacket, as desired.

Although the loop shown in the drawing is formed by placing the ends of a cord side-by-side, other loop structures also are contemplated including a pre-formed seamless loop or ring of material. While a shock cord material has been described, other fabrics and material may be suitable as would be apparent to one of skill in the art. The loop need not consist of a round cross-sectional material but may assume other shapes and may be formed of flat strip and other types of materials and therefore is not limited to cord structures. Although an elastic structure is preferred, non-elastic materials also may be suitable so long as the loop formed therefrom prevents separation of the leash from the jacket sleeve. The shape of the loop opening also may be varied depending upon the configuration of the cord lock or other anchoring member provided on the glove leash.

As illustrated, a leash extends from the glove and is attached via a barrel shaped cord lock to a loop provided on the jacket. It is contemplated that the components could be reversed with the elastic loop located on the glove and the leash extending from the jacket.

As shown in the FIGURE, the glove 12 may include a drawstring 26 and a cord lock 28 for tightening the opening of the glove casing 30 about the wearer's wrist or forearm. The cord lock 28 is attached to the glove so that the drawstring may be pulled through the cord lock to tighten the casing.

In a representative embodiment, the elastic glove loop is formed from 3 mm diameter shock cord which is joined end-to-end forming a pear or D shaped loop opening which at its widest point has a diameter of 0.375 inches and a length of 0.750 inches. The barrel shaped anchor is 1 inch long and 0.5 inches wide at its broadest dimension. The leash is 9 inches long. The adjacent end sections of the elastic loop are positioned beneath the lining or inner layers of the jacket so that only the cord section defining the opening is visible. Bar tack or other concentrated stitches are employed on the exterior and interior of the sleeve to fix the loop to the jacket cuff, preventing inadvertent tearing or pulling out of the loop. A red or other bright color loop may be used which contrasts against the color of the cuff to ensure the loop is readily visible to the user.

It should be understood that the foregoing description of the invention is intended merely to be illustrative thereof and that other equivalents, embodiments and modifications of the invention may be apparent to those skilled in the art.

I claim:

1. An arrangement for retaining an article of wear to a garment, said arrangement comprising:

a garment;

a loop secured to said garment and defining a first opening; and an article of wear including an elongated leash configured as a varyingly sized loop and provided with an anchor, including a cord lock, that has at least one dimension that is larger than said first opening, said leash extending from said article of wear so that said anchor may hang in spaced relationship from said article of wear when said article of wear is placed in an upright position;

wherein said leash extends through said loop and said anchor is positioned so that said at least one dimension is adjacent said narrower first opening, thereby preventing said anchor from passing through said loop and said article of wear from inadvertently separating from said garment.

2. An arrangement as recited in claim 1, wherein said garment includes a sleeve and said loop is secured to said sleeve.

3. An arrangement as recited in claim 2, wherein said sleeve includes a cuff and said loop is secured at said cuff.

4. An arrangement as recited in claim 3, wherein said loop is secured at an inner portion of said cuff.

5. An arrangement as recited in claim 4, wherein said garment is a jacket.

6. An arrangement as recited in claim 5, wherein said article of wear is a hand covering.

7. An arrangement as recited in claim 6, wherein said hand covering is a glove.

8. An arrangement as recited in claim 3, wherein said loop is resilient.

9. An arrangement as recited in claim 8, wherein said resilient loop is comprised of shock cord.

10. An arrangement as recited in claim 9, wherein said resilient loop is secured at said cuff with bar tack stitching.

11. An arrangement as recited in claim 1, wherein said garment is a jacket.

12. An arrangement as recited in claim 11, wherein said article of wear is a hand covering.

13. An arrangement as recited in claim 12, wherein said band covering is a glove.

14. An arrangement as recited in claim 1, wherein said anchor is barrel-shaped.

15. An arrangement as recited in claim 1, wherein said anchor is a cord lock.

16. An arrangement for retaining an article of wear to a garment, said arrangement comprising:

a garment including a first fastening member; and an article of wear including a second fastening member that is constructed and arranged to cooperate with said first fastening member to retain said article of wear to said garment and to prevent said article of wear from inadvertently being separated from said garment;

said first fastening member including one of a retainer and an elongated leash configured as a varyingly sized loop and provided with an anchor including a cord lock;

said second fastening member including lie other of said retainer and said leash with said anchor;

said leash extending from one of said garment and said article of wear so that said anchor may hang in a spaced relationship from said one of said garment and said article of wear;

wherein said retainer has an opening that is smaller than at least one dimension of said anchor, and wherein said anchor and a portion of said leash passes through said opening to selectively retain and release said article of wear respectively to and from said garment.

17. An arrangement as recited in claim 16, wherein said garment is a jacket and said article of wear is a hand covering.

18. An arrangement as recited in claim 17, wherein said jacket includes a sleeve with a cuff and said first fastening member is secured at said cuff.

19. An arrangement as recited in claim 18, wherein said first fastening member is secured to an inner portion of said cuff.

20. An arrangement as recited in claim 16, wherein said retainer is comprised of shock cord.

21. An arrangement as recited in claim 16, wherein said retainer is a loop.

22. An arrangement as recited in claim 21, wherein said loop is comprised of a stretchable cord that stretches to allow said anchor to pass through said opening and retracts to retain said anchor after passing through said opening.

23. An arrangement as recited in claim 16, wherein said anchor is barrel-shaped.

24. An arrangement for retaining an article of wear to a garment, said arrangement comprising:

a jacket including a sleeve with a cuff;

a loop secured to said jacket at said cuff of said sleeve, said loop defining a loop opening;

a hand covering including a casing having an opening through which a hand is insertable into said hand covering, said hand covering further including a drawstring and a first cord lock for tightening said opening of said casing, said drawstring to be pulled through said first cord lock to tighten said opening of said casing; and an elongated leash provided with an anchor having at least one dimension that is larger than said loop opening, said leash being secured to said hand covering and extending from said hand covering so that said anchor may hang in a spaced relationship therefrom;

wherein said anchor and a portion of said leash pass through said loop opening to selectively retain and release said hand covering respectively to and from said jacket.

25. An arrangement as recited in claim 24, wherein said hand covering is a glove.

26. An arrangement as recited in claim 24, wherein said loop is comprised of shock cord.

27. An arrangement as recited in claim 24, wherein said leash is configured as a varyingly sized loop.

28. An arrangement as recited in claim 24, wherein said anchor includes a second cord lock.

29. An arrangement as recited in claim 28, wherein said second cord lock is barrel-shaped.

30. An arrangement as recited in claim 28, wherein said second cord lock is movable along said leash.

31. An arrangement as recited in claim 24, wherein said loop is secured at an inner portion of said cuff.

* * * * *